US007309555B2

(12) United States Patent
Lee et al.

(10) Patent No.: US 7,309,555 B2
(45) Date of Patent: Dec. 18, 2007

(54) NON-MAGNETIC MONOCOMPONENT COLOR TONER AND PREPARATION METHOD THEREOF

(75) Inventors: Hyeung-Jin Lee, Busan (KR); Joo-Yong Park, Daejeon (KR); Chang-Soon Lee, Daejeon (KR)

(73) Assignee: LG Chem, Ltd, Seoul (KR)

( * ) Notice: Subject to any disclaimer, the term of this patent is extended or adjusted under 35 U.S.C. 154(b) by 372 days.

(21) Appl. No.: 11/033,178

(22) Filed: Jan. 12, 2005

(65) Prior Publication Data

US 2005/0153225 A1 Jul. 14, 2005

(30) Foreign Application Priority Data

Jan. 13, 2004 (KR) ..... 10-2004-0002281
Dec. 15, 2004 (KR) ..... 10-2004-0106176

(51) Int. Cl.
*G03G 9/08* (2006.01)

(52) U.S. Cl. ..... 430/108.6; 430/137.18

(58) Field of Classification Search ..... 430/108.6, 430/137.18

See application file for complete search history.

(56) References Cited

U.S. PATENT DOCUMENTS 5,905,011 A 5/1999 Kurose et al.
6,103,441 A 8/2000 Tomita et al.
6,127,081 A 10/2000 Yamauchi
2002/0192582 A1* 12/2002 Yamazaki et al. ..... 430/100
2003/0157419 A1* 8/2003 Miyakawa et al. ..... 430/108.6
2004/0097623 A1* 5/2004 Koeda et al. ..... 524/237

FOREIGN PATENT DOCUMENTS

JP 02-161469 6/1990
JP 11-338182 12/1999
JP 2001-242659 9/2001
JP 2002-214834 7/2002
KR 1020020061681 7/2002
KR 1020020061682 7/2002

OTHER PUBLICATIONS

International Search Report.

* cited by examiner

*Primary Examiner*—John L Goodrow
(74) *Attorney, Agent, or Firm*—McKenna Long & Aldridge LLP

(57) ABSTRACT

The present invention relates to a non-magnetic monocomponent color toner and a preparing method thereof. In the non-magnetic monocomponent color toner including a toner mother particle, silica and titanium dioxide, the toner mother particle comprises a specific shaped particle size distribution of the charge control agents, and thus, providing non-magnetic monocomponent color toner with a narrow charge distribution and good chargeability. Accordingly, the color toner does not cause contamination in the non-imaging region. Also, because it has superior image density and printing efficiency and significantly improved charge maintenance, it has good long-term stability.

8 Claims, No Drawings

NON-MAGNETIC MONOCOMPONENT COLOR TONER AND PREPARATION METHOD THEREOF

CROSS REFERENCE TO RELATED APPLICATION

This application claims priority to Korean patent applications Nos. 10-2004-0002281 filed in the Korean Intellectual Property Office on Jan. 13, 2004 and 10-2004-0106176 filed in the Korean Intellectual Property Office on Dec. 15, 2004, the entire disclosure of which is incorporated herein by reference.

BACKGROUND OF THE INVENTION (a) Field of the Invention

The present invention relates to a non-magnetic monocomponent color toner offering superior image density and printing efficiency because of a narrow charge distribution and good chargeability, and having superior long-term stability because of significantly improved charge maintenance, and a preparation method thereof.

(b) Description of the Related Art

Recently, demand for color toner is increasing in the field of electrophotography. Color toner is prepared by kneading and crushing, suspension polymerization, emulsion polymerization, etc. Among them, the kneading and crushing method is mainly used in terms of stability, productivity, and so forth.

In the kneading and crushing method, a binder resin, a colorant, a charge controller, a releasing agent, etc., are melted and kneaded to obtain a mixture. The mixture is cooled and crushed to a desired particle size and classified to obtain a toner. The toner is developed by frictional charging to a positive or negative charge depending on the polarity of the developed electrostatic latent image. Recently, printers adopting electrophotography, in which a laser beam is used as light source, have been leading the market. The demand for compactness, lightness, reliability, and full color is increasing rapidly. Thus, electrophotographic devices having a simple structure and offering high good quality and durability are required. Also, a toner having good printing efficiency and stable developing properties in the long term is required.

In order to satisfy the recent need for higher resolution and better image quality, the particle size of toner is becoming smaller. As the particle size of the toner decreases, the surface area per unit weight of the toner particle increases. As a result, the surface characteristics affect charging and particle characteristics of the toner. As the particle size becomes smaller, the charging characteristic is more affected by the charge control agent. In general, a metal complex, a chromium-containing metal dye, or a quaternary ammonium salt is used for negative charging, and nigrosine or a quaternary ammonium salt is used for positive charging, as the charge control agent. The charge control agent is melted and kneaded along with a binder resin, a wax, a colorant, etc., and crushing and classifying are performed to obtain a toner.

The raw material of the charge control agent may have quite a broad particle size distribution. Although the charge control agent particles may be broken down during melting or kneading, the original particle size determines the characteristics of the charge control agent. If the charge control agent has too large a particle size, the binding ability with the binder resin decreases, so it tends to be separated from the toner during crushing. As a result, many toner particles do not contain the charge control agent and the charge distribution becomes broader, so background contamination or fogging tends to occur. Otherwise, if the charge control agent has too small a particle size, most of the charge control agent particles exist inside the toner, so they do not contribute to improvement in charging characteristics.

Accordingly, it is required to improve binding ability with the binder resin, charge distribution, and charge maintenance by specifying the particle size and distribution of the charge control agent.

SUMMARY OF THE INVENTION

The present inventors worked for a color toner having a narrow charge distribution and good chargeability, and that is capable of improving charge maintenance. Noticing that the binding ability with the binder resin, charge distribution, charge maintenance, etc., are affected by particle size and distribution of the charge control agent, they completed the present invention by identifying that a toner comprising 10-35 wt % of a charge control agent having a particle size of 50-500 nm and 65-90 wt % of a charge control agent having a particle size of 1-4 μm has superior long-term stability because of uniform charge distribution and good chargeability.

Thus, it is an aspect of the present invention to provide a non-magnetic monocomponent color toner comprising both a toner mother particle comprising a charge control agent having a large particle size and a charge control agent having a small particle size; silica; and titanium dioxide, and a preparing method thereof.

DETAILED DESCRIPTION OF THE INVENTION

In the following detailed description, the embodiments of the invention have been shown and described, simply by way of illustrating the best mode contemplated by the inventors of carrying out the invention. As will be realized, the present invention can be modified in various respects, all without departing from the invention. Accordingly, the description is to be regarded as illustrative in nature, and not restrictive.

The present invention provides a non-magnetic monocomponent color toner comprising a toner mother particle comprising 10-35 wt % of a charge control agent having a particle size of 50-500 nm, and 65-90 wt % of a charge control agent having a particle size of 1-4 μm; silica; and titanium dioxide.

The present invention also provides a method of preparing a non-magnetic monocomponent color toner comprising the steps of preparing a toner mother particle comprising 10-35 wt % of a charge control agent having a particle size of 50-500 nm and 65-90 wt % of a charge control agent having a particle size of 1-4 μm (step 1); and coating the toner mother particle with silica and titanium dioxide (step 2).

The charge control agent used in the present invention comprises a) 10-35 wt % of a charge control agent having a particle size of 50-500 nm and b) 65-90 wt % of a charge control agent having a particle size of 14 μm. More preferably, it comprises 15-25 wt % of a charge control agent having a particle size of 150-450 nm and b) 75-85 wt % of a charge control agent having a particle size of 14 μm. The charge control agent is preferably comprised at 0.5-5 wt %, more preferably at 1-3 wt %. The silica has an average particle size of 5-50 nm, preferably 10-40 nm. It is preferably comprised at 1.0-3.0 wt %, more preferably at 1.5-2.8 wt %. The titanium dioxide has an average particle size of 0.05-2 μm, preferably 0.1-1.5 μm. It is preferably comprised at 0.2-2.5 wt %, more preferably at 0.5-2 wt %.

Unless specified otherwise, average particle size mentioned in the description of the present invention is number-average particle size.

If the content of the charge control agent having a smaller average particle size is below 10 wt %, a sufficiently uniform charge distribution is not obtained. Otherwise, if it exceeds 35 wt %, the particles having a smaller particle size, which have a much larger specific surface area, penetrate the toner particles, thereby failing to fully function as a charge control agent on the surface of the toner particle. In this case, long-term printing efficiency may deteriorate.

If the content of the charge control agent having a larger average particle size is below 65 wt %, the charge control agents having a larger average particle size tend to concentrate on the surface of the toner particle, thereby failing to offer good chargeability. Otherwise, if it exceeds 90 wt %, it is difficult to obtain uniform charge distribution, and if a lot of the charge control agent particles come into the surface, many of them are separated because they have weaker binding ability with the binder resin than the particles having a smaller particle size. As a result, it is difficult to obtain uniform charge distribution, and background contamination or fogging may occur.

For the charge control agent having a specifically shaped particle size distribution, a metal complex, a nigrosine dye, a triphenylmethane dye, a quaternary ammonium salt, or an organotartar compound such as dibutyl tin oxide, etc. may be used. The metal of the metal complex may be Al, Zr, Zn, Ba, etc. Although such intrinsic property of the charge control agent as positive chargeability or negative chargeability does not change, a narrower charge distribution and a better chargeability can be obtained with a specific particle size distribution.

The toner mother particle also comprises a binder resin, a colorant, and a wax as essential components.

The binder resin may be a styrene such as styrene, chlorostyrene and vinylstyrene; an olefin such as ethylene, propylene, butylene and isoprene; a vinyl ester such as vinyl acetate, vinyl propionate, vinyl benzoate and vinyl lactate; an acrylate or a methacrylate such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; a vinyl ether such as vinyl methyl ether, vinyl ethyl ether, and vinyl butyl ether; a vinyl ketone such as vinyl methyl ketone, vinyl hexyl ketone, and vinyl isopropenyl ketone; and a mixture thereof.

Preferably, polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene, etc. is used. More preferably, polyester, polyurethane, an epoxy resin, a silicone resin, polyamide, a modified resin, paraffin, etc. is used.

For the colorant, carbon black, a magnetic paint, a dye, or a pigment may be used. For example, a nigrosine dye, aniline blue, charcoal blue, chromium yellow, navy blue, DuPont oil red, methylene blue chloride, phthalocyanine blue, lamp black, rose bengal, C.I. pigment red 48:1, C.I. pigment red 48:4, C.I. pigment red 122, C.I. pigment red 57:1, C.I. pigment red 257, C.I. pigment red 269, C.I. pigment yellow 97, C.I. pigment yellow 12, C.I. pigment yellow 17, C.I. pigment yellow 14, C.I. pigment yellow 13, C.I. pigment yellow 16, C.I. pigment yellow 81, C.I. pigment yellow 126, C.I. pigment yellow 127, C.I. pigment blue 9, C.I. pigment blue 15, C.I. pigment blue 15:1, C.I. pigment blue 15:3, etc. may be used.

An inorganic oxide fine particle such as $SiO_2$, $TiO_2$, MgO, $Al_2O_3$, MnO, ZnO, $Fe_2O_3$, CaO, $BaSO_4$, $CeO_2$, $K_2O$, $Na_2O$, $ZrO_2$, CaO.SiO, $K_2O.(TiO_2)_n$ and $Al_2O_3.2SiO_2$ hydrophobic-treated with hexamethyldisilazane, dimethyldichlorosilane, octyltrimethoxysilane, etc. may be added to the toner mother particle as a fluidity accelerator. The toner mother particle may further comprise a releasing agent.

The toner mother particle preferably has an average particle size of 10 μm, more preferably 4-10 μm, and most preferably 5-9 μm.

After a toner mother particle is prepared by mixing and kneading the charge control agent, which has a specific shaped particle size distribution, along with a binder resin, a colorant and a wax (releasing agent), silica and titanium oxide particles are added to prepare the non-magnetic monocomponent color toner of the present invention.

The silica preferably has an average particle size of 5-50 nm, preferably 10-40 nm. It is preferably comprised at 1.0-3.0 wt %, more preferably at 1.5-2.8 wt %. The titanium dioxide preferably has an average particle size of 0.05-2 μm, more preferably 0.1-1.5 μm. It is preferably comprised at 0.2-2.5 wt %, more preferably at 0.5-2wt %.

Although the silica and the titanium dioxide may be attached to the surface of the toner mother particle electrostatically, a mechanical mixing treatment using a Henschel mixer, a hybridizer, etc. is preferable. Preferably, the toner mother particle, silica, and titanium dioxide are coated after being mixed at a stirring rate of at least 10 m/s.

The resultant non-magnetic monocomponent color toner preferably has an average particle size of at most 20 μm, more preferably 3-15 μm.

The non-magnetic monocomponent color toner of the present invention offers better long-term image stability than the conventional counterpart. It is also advantageous in offering higher resolution, better printing efficiency, and clearer color. The better effect is attained as the toner particle has the smaller size.

Accordingly, a non-magnetic monocomponent color toner having good chargeability, charge maintenance, and clear color can be prepared according to the present invention. The toner is more environmentally friendly and can offer a more stable image while satisfying the need of higher resolution.

Hereinafter, the present invention is described in more detail through examples. However, the following examples are only for the understanding of the present invention and they do not limit the present invention.

EXAMPLE 1

1) Preparation of Toner Mother Particle 94 parts by weight of polyester resin (molecular weight=$2.5\times10^5$), 4 parts by weight of phthalocyanine P.BI.15:3, 1 part by weight of a metal-containing azo salt (charge control agent C) comprising 30 wt % of a particle having a particle size of 50-500 nm and 70 wt % of a particle having a particle size of 1-4 μm, and 4 parts by weight of polypropylene having a small molecular weight were mixed using a Henschel mixer. The mixture was melted and kneaded at 165° C. using a twin melt kneader, crushed using a jet mil crusher, and classified using an air classifier to obtain a toner mother particle having a volume-average particle size of 7.5 μm.

2) Preparation of Non-magnetic Monocomponent Color Toner 2.0 wt % of silica having an average particle size of 17 nm and 1.0 wt % of titanium dioxide particle having an average particle size of 0.1 μm were mixed with 100 parts by weight of the prepared toner mother particle while stirring for 3 minutes at a tip speed of at least 10 m/s using a Henschel mixer to obtain a non-magnetic monocomponent color toner.

EXAMPLES 2-182

Non-magnetic monocomponent color-toners were prepared in the same manner of Example 1, except that charge control agents presented in Table 1 below, silica presented in Table 2 below, and titanium dioxide presented in Table 3 below were used according to the composition given in Table 4 below.

TABLE 1

| | Compounds | Average particle size distribution |
|---|---|---|
| Charge control agent A | Metal-containing azo salt | 50-500 nm |
| Charge control agent B | Metal-containing azo salt | 1-4 μm |
| Charge control agent C | Metal-containing azo salt | 50-500 nm, 30 wt %; 1-4 μm, 70 wt % |
| Charge control agent D | Quaternary ammonium salt | 50-500 nm |
| Charge control agent E | Quaternary ammonium salt | 1-4 μm |
| Charge control agent F | Quaternary ammonium salt | 50-500 nm, 30 wt %; 1-4 μm, 70 wt % |
| Charge control agent G | Zinc salicylate | 50-500 nm |
| Charge control agent H | Zinc salicylate | 1-4 μm |
| Charge control agent I | Zinc salicylate | 50-500 nm, 30 wt %; 1-4 μm, 70 wt % |
| Charge control agent J | Boron complex | 50-500 nm |
| Charge control agent K | Boron complex | 1-4 μm |

TABLE 1-continued

| | Compounds | Average particle size distribution |
|---|---|---|
| Charge control agent L | Boron complex | 50-500 nm, 30 wt %; 1-4 μm, 70 wt % |
| Charge control agent M | Metal-containing azo salt | 50-500 nm, 15 wt %; 1-4 μm, 85 wt % |
| Charge control agent N | Quaternary ammonium salt | 50-500 nm, 20 wt %; 1-4 μm, 80 wt % |
| Charge control agent O | Boron complex | 50-500 nm, 10 wt %; 1-4 μm, 90 wt % |
| Charge control agent P | Zinc salicylate | 30-300 nm, 85 wt %; 1-4 μm, 15 wt % |
| Charge control agent Q | Metal-containing azo salt | 30-300 nm, 90 wt %; 1-4 μm, 10 wt % |
| Charge control agent R | Quaternary ammonium salt | 30-300 nm, 85 wt %; 1-4 μm, 15 wt % |
| Charge control agent S | Boron complex | 30-300 nm, 85 wt %; 1-4 μm, 15 wt % |

TABLE 2

| | Specific surface area ($m^2/g$)*1 | Hydrophobic surface treatment |
|---|---|---|
| Silica A | 7 | Dimethyl silicone oil |
| Silica B | 17 | Dimethyl silicone oil |
| Silica C | 50 | HMDS*2 |

*1BET measurement values
*2HMDS = hexamethyldisilazane

TABLE 3

| | Average particle size (μm) |
|---|---|
| Titanium dioxide A | 0.1 |
| Titanium dioxide B | 1.1 |
| Titanium dioxide C | 1.6 |

TABLE 4

| Example | Charge control agent(wt %) | | Silica (wt %) | | Titanium oxide(wt %) | |
|---|---|---|---|---|---|---|
| 2 | Charge control agent C | 1.0 | Silica A | 1.0 | Titanium oxide A | 0.5 |
| 3 | Charge control agent C | 1.0 | Silica A | 1.0 | Titanium oxide A | 1.0 |
| 4 | Charge control agent C | 1.0 | Silica A | 1.0 | Titanium oxide A | 2.0 |
| 5 | Charge control agent C | 1.0 | Silica A | 1.0 | Titanium oxide B | 0.5 |
| 6 | Charge control agent C | 1.0 | Silica A | 1.0 | Titanium oxide B | 1.0 |
| 7 | Charge control agent C | 1.0 | Silica A | 1.0 | Titanium oxide B | 2.5 |
| 8 | Charge control agent C | 1.0 | Silica A | 1.0 | Titanium oxide C | 0.5 |
| 9 | Charge control agent C | 1.0 | Silica A | 2.0 | Titanium oxide C | 1.0 |
| 10 | Charge control agent C | 1.0 | Silica A | 3.0 | Titanium oxide C | 2.0 |
| 11 | Charge control agent C | 1.0 | Silica B | 1.0 | Titanium oxide A | 0.5 |
| 12 | Charge control agent C | 1.0 | Silica B | 1.0 | Titanium oxide A | 1.0 |
| 13 | Charge control agent C | 1.0 | Silica B | 1.0 | Titanium oxide A | 2.5 |
| 14 | Charge control agent C | 1.0 | Silica B | 1.0 | Titanium oxide B | 0.5 |
| 15 | Charge control agent C | 1.0 | Silica B | 1.0 | Titanium oxide B | 1.0 |
| 16 | Charge control agent C | 1.0 | Silica B | 1.0 | Titanium oxide B | 2.0 |
| 17 | Charge control agent C | 1.0 | Silica B | 1.0 | Titanium oxide C | 0.5 |
| 18 | Charge control agent C | 1.0 | Silica B | 1.0 | Titanium oxide C | 1.0 |
| 19 | Charge control agent C | 1.0 | Silica B | 3.0 | Titanium oxide C | 2.0 |
| 20 | Charge control agent C | 3.0 | Silica C | 1.0 | Titanium oxide A | 0.5 |
| 21 | Charge control agent C | 3.0 | Silica C | 1.0 | Titanium oxide A | 1.0 |
| 22 | Charge control agent C | 3.0 | Silica C | 1.0 | Titanium oxide A | 2.0 |
| 23 | Charge control agent C | 3.0 | Silica C | 1.0 | Titanium oxide B | 0.5 |
| 24 | Charge control agent C | 3.0 | Silica C | 1.0 | Titanium oxide B | 1.0 |
| 25 | Charge control agent C | 3.0 | Silica C | 1.0 | Titanium oxide B | 2.0 |
| 26 | Charge control agent C | 3.0 | Silica C | 1.0 | Titanium oxide C | 0.5 |

TABLE 4-continued

| Example | Charge control agent(wt %) | | Silica (wt %) | | Titanium oxide(wt %) | |
|---|---|---|---|---|---|---|
| 27 | Charge control agent C | 3.0 | Silica C | 2.0 | Titanium oxide C | 1.0 |
| 28 | Charge control agent C | 3.0 | Silica C | 3.0 | Titanium oxide C | 2.0 |
| 29 | Charge control agent F | 3.0 | Silica A | 1.0 | Titanium oxide A | 0.5 |
| 30 | Charge control agent F | 3.0 | Silica A | 1.0 | Titanium oxide A | 1.0 |
| 31 | Charge control agent F | 3.0 | Silica A | 1.0 | Titanium oxide A | 2.0 |
| 32 | Charge control agent F | 3.0 | Silica A | 1.0 | Titanium oxide B | 0.5 |
| 33 | Charge control agent F | 3.0 | Silica A | 1.0 | Titanium oxide B | 1.0 |
| 34 | Charge control agent F | 3.0 | Silica A | 1.0 | Titanium oxide B | 2.0 |
| 35 | Charge control agent F | 3.0 | Silica A | 1.0 | Titanium oxide C | 0.5 |
| 36 | Charge control agent F | 3.0 | Silica A | 1.0 | Titanium oxide C | 1.0 |
| 37 | Charge control agent F | 3.0 | Silica A | 1.0 | Titanium oxide C | 2.0 |
| 38 | Charge control agent F | 3.0 | Silica B | 1.0 | Titanium oxide A | 0.5 |
| 39 | Charge control agent F | 3.0 | Silica B | 1.0 | Titanium oxide A | 1.0 |
| 40 | Charge control agent F | 3.0 | Silica B | 1.0 | Titanium oxide A | 2.0 |
| 41 | Charge control agent F | 3.0 | Silica B | 1.0 | Titanium oxide B | 0.5 |
| 42 | Charge control agent F | 3.0 | Silica B | 1.0 | Titanium oxide B | 1.0 |
| 43 | Charge control agent F | 3.0 | Silica B | 1.0 | Titanium oxide B | 2.0 |
| 44 | Charge control agent F | 3.0 | Silica B | 1.0 | Titanium oxide C | 0.5 |
| 45 | Charge control agent F | 3.0 | Silica B | 1.0 | Titanium oxide C | 1.0 |
| 46 | Charge control agent F | 3.0 | Silica B | 1.0 | Titanium oxide C | 2.0 |
| 47 | Charge control agent F | 3.0 | Silica C | 2.0 | Titanium oxide A | 0.5 |
| 48 | Charge control agent F | 3.0 | Silica C | 2.0 | Titanium oxide A | 1.0 |
| 49 | Charge control agent F | 3.0 | Silica C | 2.0 | Titanium oxide A | 2.0 |
| 50 | Charge control agent F | 3.0 | Silica C | 2.0 | Titanium oxide B | 0.5 |
| 51 | Charge control agent F | 3.0 | Silica C | 2.0 | Titanium oxide B | 1.0 |
| 52 | Charge control agent F | 3.0 | Silica C | 2.0 | Titanium oxide B | 2.0 |
| 53 | Charge control agent F | 3.0 | Silica C | 2.0 | Titanium oxide C | 0.5 |
| 54 | Charge control agent F | 3.0 | Silica C | 3.0 | Titanium oxide C | 1.0 |
| 55 | Charge control agent F | 3.0 | Silica C | 3.0 | Titanium oxide C | 2.0 |
| 56 | Charge control agent I | 1.0 | Silica A | 1.0 | Titanium oxide C | 2.0 |
| 57 | Charge control agent I | 1.0 | Silica A | 1.0 | Titanium oxide C | 0.5 |
| 58 | Charge control agent I | 1.0 | Silica A | 1.0 | Titanium oxide C | 1.0 |
| 59 | Charge control agent I | 1.0 | Silica A | 1.0 | Titanium oxide C | 2.0 |
| 60 | Charge control agent I | 1.0 | Silica A | 1.0 | Titanium oxide A | 0.5 |
| 61 | Charge control agent I | 1.0 | Silica A | 1.0 | Titanium oxide A | 1.0 |
| 62 | Charge control agent I | 1.0 | Silica A | 1.0 | Titanium oxide A | 2.5 |
| 63 | Charge control agent I | 3.0 | Silica A | 1.0 | Titanium oxide A | 0.5 |
| 64 | Charge control agent I | 3.0 | Silica A | 1.0 | Titanium oxide A | 2.0 |
| 65 | Charge control agent I | 3.0 | Silica A | 1.0 | Titanium oxide B | 0.5 |
| 66 | Charge control agent I | 3.0 | Silica B | 2.0 | Titanium oxide A | 1.5 |
| 67 | Charge control agent I | 3.0 | Silica B | 2.0 | Titanium oxide C | 0.5 |
| 68 | Charge control agent I | 3.0 | Silica B | 2.0 | Titanium oxide C | 2.0 |
| 69 | Charge control agent I | 3.0 | Silica B | 2.0 | Titanium oxide C | 0.5 |
| 70 | Charge control agent I | 3.0 | Silica B | 2.0 | Titanium oxide B | 1.5 |
| 71 | Charge control agent I | 3.0 | Silica B | 3.0 | Titanium oxide C | 1.0 |
| 72 | Charge control agent I | 3.0 | Silica B | 2.0 | Titanium oxide A | 2.0 |
| 73 | Charge control agent L | 1.0 | Silica A | 1.0 | Titanium oxide A | 0.5 |
| 74 | Charge control agent L | 1.0 | Silica A | 1.0 | Titanium oxide A | 1.5 |
| 75 | Charge control agent L | 1.0 | Silica A | 1.0 | Titanium oxide B | 0.5 |
| 76 | Charge control agent L | 1.0 | Silica A | 1.0 | Titanium oxide B | 1.5 |
| 77 | Charge control agent L | 1.0 | Silica A | 1.0 | Titanium oxide C | 0.5 |
| 78 | Charge control agent L | 1.0 | Silica A | 1.0 | Titanium oxide C | 2.5 |
| 79 | Charge control agent L | 1.0 | Silica A | 3.0 | Titanium oxide A | 0.5 |
| 80 | Charge control agent L | 1.0 | Silica A | 3.0 | Titanium oxide B | 0.5 |
| 81 | Charge control agent L | 1.0 | Silica A | 3.0 | Titanium oxide C | 0.5 |
| 82 | Charge control agent L | 1.0 | Silica A | 3.0 | Titanium oxide A | 1.5 |
| 83 | Charge control agent L | 1.0 | Silica B | 2.0 | Titanium oxide A | 0.5 |
| 84 | Charge control agent L | 1.0 | Silica B | 2.0 | Titanium oxide A | 1.0 |
| 85 | Charge control agent L | 1.0 | Silica B | 2.0 | Titanium oxide A | 2.5 |
| 86 | Charge control agent L | 1.0 | Silica B | 2.0 | Titanium oxide B | 0.5 |
| 87 | Charge control agent L | 1.0 | Silica B | 2.0 | Titanium oxide B | 1.0 |
| 88 | Charge control agent L | 1.0 | Silica B | 2.0 | Titanium oxide B | 2.5 |
| 89 | Charge control agent L | 1.0 | Silica B | 2.0 | Titanium oxide C | 0.5 |
| 90 | Charge control agent L | 1.0 | Silica B | 2.0 | Titanium oxide C | 1.0 |
| 91 | Charge control agent L | 1.0 | Silica B | 2.0 | Titanium oxide C | 2.0 |
| 92 | Charge control agent L | 2.0 | Silica B | 2.0 | Titanium oxide C | 2.0 |
| 93 | Charge control agent L | 1.0 | Silica C | 2.0 | Titanium oxide A | 0.5 |
| 94 | Charge control agent L | 3.0 | Silica C | 2.0 | Titanium oxide A | 1.5 |
| 95 | Charge control agent L | 3.0 | Silica C | 2.0 | Titanium oxide A | 2.5 |
| 96 | Charge control agent L | 3.0 | Silica C | 2.0 | Titanium oxide B | 0.5 |
| 97 | Charge control agent L | 3.0 | Silica C | 2.0 | Titanium oxide B | 1.0 |
| 98 | Charge control agent L | 3.0 | Silica C | 2.0 | Titanium oxide B | 2.0 |
| 99 | Charge control agent L | 3.0 | Silica C | 2.0 | Titanium oxide C | 0.5 |
| 100 | Charge control agent L | 2.0 | Silica C | 2.0 | Titanium oxide C | 1.0 |
| 101 | Charge control agent L | 2.0 | Silica C | 2.0 | Titanium oxide C | 2.0 |
| 102 | Charge control agent M | 1.0 | Silica A | 0.5 | Titanium oxide A | 0.5 |
| 103 | Charge control agent M | 1.0 | Silica A | 1.0 | Titanium oxide A | 1.0 |

TABLE 4-continued

| Example | Charge control agent(wt %) | | Silica (wt %) | | Titanium oxide(wt %) | |
|---|---|---|---|---|---|---|
| 104 | Charge control agent M | 1.0 | Silica A | 1.0 | Titanium oxide A | 2.0 |
| 105 | Charge control agent M | 1.0 | Silica A | 1.0 | Titanium oxide B | 0.5 |
| 106 | Charge control agent M | 1.0 | Silica A | 1.0 | Titanium oxide B | 1.0 |
| 107 | Charge control agent M | 1.0 | Silica A | 1.0 | Titanium oxide B | 2.0 |
| 108 | Charge control agent M | 1.0 | Silica A | 2.0 | Titanium oxide C | 0.5 |
| 109 | Charge control agent M | 1.0 | Silica A | 2.0 | Titanium oxide C | 1.0 |
| 110 | Charge control agent M | 1.0 | Silica A | 3.0 | Titanium oxide C | 2.5 |
| 111 | Charge control agent M | 1.0 | Silica B | 1.0 | Titanium oxide A | 0.5 |
| 112 | Charge control agent M | 2.0 | Silica B | 1.0 | Titanium oxide A | 1.0 |
| 113 | Charge control agent M | 2.0 | Silica B | 1.0 | Titanium oxide A | 2.0 |
| 114 | Charge control agent M | 2.0 | Silica B | 1.0 | Titanium oxide B | 0.5 |
| 115 | Charge control agent M | 2.0 | Silica B | 1.0 | Titanium oxide B | 1.0 |
| 116 | Charge control agent M | 2.0 | Silica B | 1.0 | Titanium oxide B | 2.0 |
| 117 | Charge control agent M | 2.0 | Silica B | 1.0 | Titanium oxide C | 0.5 |
| 118 | Charge control agent M | 2.0 | Silica B | 2.0 | Titanium oxide C | 1.0 |
| 119 | Charge control agent M | 2.0 | Silica B | 3.0 | Titanium oxide C | 2.0 |
| 120 | Charge control agent M | 2.0 | Silica C | 1.0 | Titanium oxide A | 0.5 |
| 121 | Charge control agent M | 2.0 | Silica C | 1.0 | Titanium oxide A | 1.0 |
| 122 | Charge control agent M | 2.0 | Silica C | 1.0 | Titanium oxide A | 2.0 |
| 123 | Charge control agent M | 2.0 | Silica C | 1.0 | Titanium oxide B | 0.5 |
| 124 | Charge control agent M | 3.0 | Silica C | 1.0 | Titanium oxide B | 1.0 |
| 125 | Charge control agent M | 3.0 | Silica C | 3.0 | Titanium oxide B | 2.0 |
| 126 | Charge control agent M | 3.0 | Silica C | 2.0 | Titanium oxide C | 0.5 |
| 127 | Charge control agent M | 3.0 | Silica C | 2.0 | Titanium oxide C | 1.0 |
| 128 | Charge control agent M | 3.0 | Silica C | 3.0 | Titanium oxide C | 2.5 |
| 129 | Charge control agent N | 1.0 | Silica A | 1.0 | Titanium oxide A | 0.5 |
| 130 | Charge control agent N | 1.0 | Silica A | 1.0 | Titanium oxide A | 1.0 |
| 131 | Charge control agent N | 1.0 | Silica A | 1.0 | Titanium oxide A | 2.0 |
| 132 | Charge control agent N | 1.0 | Silica A | 1.0 | Titanium oxide B | 0.5 |
| 133 | Charge control agent N | 1.0 | Silica A | 1.0 | Titanium oxide B | 1.0 |
| 134 | Charge control agent N | 1.0 | Silica A | 1.0 | Titanium oxide B | 2.0 |
| 135 | Charge control agent N | 1.0 | Silica A | 2.0 | Titanium oxide C | 0.5 |
| 136 | Charge control agent N | 1.0 | Silica A | 3.0 | Titanium oxide C | 1.0 |
| 137 | Charge control agent N | 1.0 | Silica A | 2.0 | Titanium oxide C | 2.0 |
| 138 | Charge control agent N | 2.0 | Silica B | 1.0 | Titanium oxide A | 0.5 |
| 139 | Charge control agent N | 2.0 | Silica B | 1.0 | Titanium oxide A | 1.0 |
| 140 | Charge control agent N | 2.0 | Silica B | 1.0 | Titanium oxide A | 2.5 |
| 141 | Charge control agent N | 2.0 | Silica B | 1.0 | Titanium oxide B | 0.5 |
| 142 | Charge control agent N | 2.0 | Silica B | 1.0 | Titanium oxide B | 1.0 |
| 143 | Charge control agent N | 2.0 | Silica B | 1.0 | Titanium oxide B | 2.0 |
| 144 | Charge control agent N | 2.0 | Silica B | 1.0 | Titanium oxide C | 0.5 |
| 145 | Charge control agent N | 2.0 | Silica B | 3.0 | Titanium oxide C | 1.0 |
| 146 | Charge control agent N | 2.0 | Silica B | 3.0 | Titanium oxide C | 2.0 |
| 147 | Charge control agent N | 2.0 | Silica C | 2.0 | Titanium oxide A | 0.5 |
| 148 | Charge control agent N | 3.0 | Silica C | 1.0 | Titanium oxide A | 1.0 |
| 149 | Charge control agent N | 3.0 | Silica C | 1.0 | Titanium oxide A | 2.0 |
| 150 | Charge control agent N | 4.0 | Silica C | 1.0 | Titanium oxide B | 0.5 |
| 151 | Charge control agent N | 4.0 | Silica C | 1.0 | Titanium oxide B | 1.0 |
| 152 | Charge control agent N | 4.0 | Silica C | 1.0 | Titanium oxide B | 2.0 |
| 153 | Charge control agent N | 5.0 | Silica C | 1.0 | Titanium oxide C | 0.5 |
| 154 | Charge control agent N | 5.0 | Silica C | 3.0 | Titanium oxide C | 1.0 |
| 155 | Charge control agent N | 5.0 | Silica C | 2.0 | Titanium oxide C | 2.0 |
| 156 | Charge control agent O | 1.0 | Silica A | 1.0 | Titanium oxide A | 0.5 |
| 157 | Charge control agent O | 1.0 | Silica A | 1.0 | Titanium oxide A | 1.0 |
| 158 | Charge control agent O | 1.0 | Silica A | 1.0 | Titanium oxide A | 2.0 |
| 159 | Charge control agent O | 1.0 | Silica A | 1.0 | Titanium oxide B | 0.5 |
| 160 | Charge control agent O | 1.0 | Silica A | 2.0 | Titanium oxide B | 1.0 |
| 161 | Charge control agent O | 1.0 | Silica A | 2.0 | Titanium oxide B | 2.0 |
| 162 | Charge control agent O | 2.0 | Silica A | 1.0 | Titanium oxide C | 0.5 |
| 163 | Charge control agent O | 2.0 | Silica A | 1.0 | Titanium oxide C | 1.0 |
| 164 | Charge control agent O | 2.0 | Silica A | 1.0 | Titanium oxide C | 2.0 |
| 165 | Charge control agent O | 1.0 | Silica B | 1.0 | Titanium oxide A | 0.5 |
| 166 | Charge control agent O | 2.0 | Silica B | 1.0 | Titanium oxide A | 1.0 |
| 167 | Charge control agent O | 2.0 | Silica B | 1.0 | Titanium oxide A | 2.0 |
| 168 | Charge control agent O | 2.0 | Silica B | 1.0 | Titanium oxide B | 0.5 |
| 169 | Charge control agent O | 2.0 | Silica B | 1.0 | Titanium oxide B | 1.0 |
| 170 | Charge control agent O | 2.0 | Silica B | 1.0 | Titanium oxide B | 2.0 |
| 171 | Charge control agent O | 2.0 | Silica B | 1.0 | Titanium oxide C | 0.5 |
| 172 | Charge control agent O | 2.0 | Silica B | 1.0 | Titanium oxide C | 1.0 |
| 173 | Charge control agent O | 2.0 | Silica B | 1.0 | Titanium oxide C | 2.5 |
| 174 | Charge control agent O | 2.0 | Silica C | 1.0 | Titanium oxide A | 0.5 |
| 175 | Charge control agent O | 3.0 | Silica C | 1.0 | Titanium oxide A | 1.0 |
| 176 | Charge control agent O | 3.0 | Silica C | 1.0 | Titanium oxide A | 2.0 |
| 177 | Charge control agent O | 3.0 | Silica C | 1.0 | Titanium oxide B | 0.5 |
| 178 | Charge control agent O | 4.0 | Silica C | 1.0 | Titanium oxide B | 1.0 |
| 179 | Charge control agent O | 4.0 | Silica C | 1.0 | Titanium oxide B | 2.0 |
| 180 | Charge control agent O | 4.0 | Silica C | 1.0 | Titanium oxide C | 0.5 |

TABLE 4-continued

| Example | Charge control agent(wt %) | | Silica (wt %) | | Titanium oxide(wt %) | |
|---|---|---|---|---|---|---|
| 181 | Charge control agent O | 5.0 | Silica C | 1.0 | Titanium oxide C | 1.0 |
| 182 | Charge control agent O | 5.0 | Silica C | 1.0 | Titanium oxide C | 2.0 |

COMPARATIVE EXAMPLES 1-270

Non-magnetic monocomponent color toners were prepared in the same manner of Example 1, except that charge control agents presented in Table 1 above, silica presented in Table 2 above, and titanium dioxide presented in Table 3 above were used according to the composition given in Table 5 below. That is to say, charge control agents not having a specific shaped particle size were used in the Comparative Examples.

TABLE 5

| Comparative Example | Charge control agent(wt %) | | Silica(wt %) | | Titanium oxide (wt %) | |
|---|---|---|---|---|---|---|
| 1 | Charge control agent A | 1.0 | Silica A | 1.0 | Titanium oxide A | 0.5 |
| 2 | Charge control agent A | 2.0 | Silica A | 1.0 | Titanium oxide A | 0.5 |
| 3 | Charge control agent A | 1.0 | Silica A | 1.0 | Titanium oxide A | 1.0 |
| 4 | Charge control agent A | 1.0 | Silica A | 1.0 | Titanium oxide A | 2.0 |
| 5 | Charge control agent A | 1.0 | Silica A | 1.0 | Titanium oxide B | 0.5 |
| 6 | Charge control agent A | 1.0 | Silica A | 1.0 | Titanium oxide B | 1.0 |
| 7 | Charge control agent A | 1.0 | Silica A | 1.0 | Titanium oxide B | 2.0 |
| 8 | Charge control agent A | 1.0 | Silica A | 1.0 | Titanium oxide C | 0.5 |
| 9 | Charge control agent A | 1.0 | Silica A | 1.0 | Titanium oxide C | 1.0 |
| 10 | Charge control agent A | 1.0 | Silica A | 1.0 | Titanium oxide C | 2.0 |
| 11 | Charge control agent A | 1.0 | Silica B | 1.0 | Titanium oxide A | 0.5 |
| 12 | Charge control agent A | 1.0 | Silica B | 1.0 | Titanium oxide A | 1.0 |
| 13 | Charge control agent A | 1.0 | Silica B | 1.0 | Titanium oxide A | 2.0 |
| 14 | Charge control agent A | 1.0 | Silica B | 1.0 | Titanium oxide B | 0.5 |
| 15 | Charge control agent A | 1.0 | Silica B | 1.0 | Titanium oxide B | 1.0 |
| 16 | Charge control agent A | 1.0 | Silica B | 1.0 | Titanium oxide B | 2.0 |
| 17 | Charge control agent A | 1.0 | Silica B | 1.0 | Titanium oxide C | 0.5 |
| 18 | Charge control agent A | 1.0 | Silica B | 1.0 | Titanium oxide C | 1.0 |
| 19 | Charge control agent A | 1.0 | Silica B | 1.0 | Titanium oxide C | 2.0 |
| 20 | Charge control agent A | 3.0 | Silica C | 1.0 | Titanium oxide A | 0.5 |
| 21 | Charge control agent A | 3.0 | Silica C | 1.0 | Titanium oxide A | 1.0 |
| 22 | Charge control agent A | 3.0 | Silica C | 1.0 | Titanium oxide A | 2.0 |
| 23 | Charge control agent A | 3.0 | Silica C | 1.0 | Titanium oxide B | 0.5 |
| 24 | Charge control agent A | 3.0 | Silica C | 1.0 | Titanium oxide B | 1.0 |
| 25 | Charge control agent A | 3.0 | Silica C | 1.0 | Titanium oxide B | 2.0 |
| 26 | Charge control agent A | 3.0 | Silica C | 1.0 | Titanium oxide C | 0.5 |
| 27 | Charge control agent A | 3.0 | Silica C | 1.0 | Titanium oxide C | 1.0 |
| 28 | Charge control agent A | 3.0 | Silica C | 1.0 | Titanium oxide C | 2.0 |
| 29 | Charge control agent B | 3.0 | Silica A | 1.0 | Titanium oxide A | 0.5 |
| 30 | Charge control agent B | 3.0 | Silica A | 1.0 | Titanium oxide A | 1.0 |
| 31 | Charge control agent B | 3.0 | Silica A | 1.0 | Titanium oxide A | 2.0 |
| 32 | Charge control agent B | 3.0 | Silica A | 1.0 | Titanium oxide B | 0.5 |
| 33 | Charge control agent B | 3.0 | Silica A | 1.0 | Titanium oxide B | 1.0 |
| 34 | Charge control agent B | 3.0 | Silica A | 1.0 | Titanium oxide B | 2.0 |
| 35 | Charge control agent B | 3.0 | Silica A | 1.0 | Titanium oxide C | 0.5 |
| 36 | Charge control agent B | 3.0 | Silica A | 1.0 | Titanium oxide C | 1.0 |
| 37 | Charge control agent B | 3.0 | Silica A | 1.0 | Titanium oxide C | 2.0 |
| 38 | Charge control agent B | 3.0 | Silica B | 1.0 | Titanium oxide A | 0.5 |
| 39 | Charge control agent B | 3.0 | Silica B | 1.0 | Titanium oxide A | 1.0 |
| 40 | Charge control agent B | 3.0 | Silica B | 1.0 | Titanium oxide A | 2.0 |
| 41 | Charge control agent B | 3.0 | Silica B | 1.0 | Titanium oxide B | 0.5 |
| 42 | Charge control agent B | 3.0 | Silica B | 1.0 | Titanium oxide B | 1.0 |
| 43 | Charge control agent B | 3.0 | Silica B | 1.0 | Titanium oxide B | 2.0 |
| 44 | Charge control agent B | 3.0 | Silica B | 1.0 | Titanium oxide C | 0.5 |
| 45 | Charge control agent B | 3.0 | Silica B | 1.0 | Titanium oxide C | 1.0 |
| 46 | Charge control agent B | 3.0 | Silica B | 1.0 | Titanium oxide C | 2.0 |
| 47 | Charge control agent B | 3.0 | Silica C | 2.0 | Titanium oxide A | 0.5 |
| 48 | Charge control agent B | 3.0 | Silica C | 2.0 | Titanium oxide A | 1.0 |
| 49 | Charge control agent B | 3.0 | Silica C | 2.0 | Titanium oxide A | 2.0 |
| 50 | Charge control agent B | 3.0 | Silica C | 2.0 | Titanium oxide B | 0.5 |
| 51 | Charge control agent B | 3.0 | Silica C | 2.0 | Titanium oxide B | 1.0 |
| 52 | Charge control agent B | 3.0 | Silica C | 2.0 | Titanium oxide B | 2.0 |
| 53 | Charge control agent B | 3.0 | Silica C | 2.0 | Titanium oxide C | 0.5 |
| 54 | Charge control agent B | 3.0 | Silica C | 2.0 | Titanium oxide C | 1.0 |
| 55 | Charge control agent B | 3.0 | Silica C | 2.0 | Titanium oxide C | 2.0 |
| 56 | Charge control agent D | 1.0 | Silica A | 1.0 | Titanium oxide C | 3.0 |
| 57 | Charge control agent D | 1.0 | Silica A | 1.0 | Titanium oxide C | 0.5 |
| 58 | Charge control agent D | 1.0 | Silica A | 1.0 | Titanium oxide C | 1.0 |

TABLE 5-continued

| Comparative Example | Charge control agent(wt %) | | Silica(wt %) | | Titanium oxide (wt %) | |
|---|---|---|---|---|---|---|
| 59 | Charge control agent D | 1.0 | Silica A | 1.0 | Titanium oxide C | 2.0 |
| 60 | Charge control agent D | 1.0 | Silica A | 1.0 | Titanium oxide A | 0.5 |
| 61 | Charge control agent D | 1.0 | Silica A | 1.0 | Titanium oxide A | 1.0 |
| 62 | Charge control agent D | 1.0 | Silica A | 1.0 | Titanium oxide A | 2.0 |
| 63 | Charge control agent D | 3.0 | Silica A | 1.0 | Titanium oxide A | 0.5 |
| 64 | Charge control agent D | 3.0 | Silica A | 1.0 | Titanium oxide A | 2.0 |
| 65 | Charge control agent D | 3.0 | Silica A | 1.0 | Titanium oxide B | 0.5 |
| 66 | Charge control agent D | 3.0 | Silica B | 2.0 | Titanium oxide A | 1.5 |
| 67 | Charge control agent D | 3.0 | Silica B | 2.0 | Titanium oxide C | 0.5 |
| 68 | Charge control agent D | 3.0 | Silica B | 2.0 | Titanium oxide C | 2.0 |
| 69 | Charge control agent D | 3.0 | Silica B | 2.0 | Titanium oxide C | 0.5 |
| 70 | Charge control agent D | 3.0 | Silica B | 2.0 | Titanium oxide B | 1.5 |
| 71 | Charge control agent D | 3.0 | Silica B | 2.0 | Titanium oxide C | 1.0 |
| 72 | Charge control agent D | 3.0 | Silica B | 2.0 | Titanium oxide A | 2.0 |
| 73 | Charge control agent E | 1.0 | Silica A | 1.0 | Titanium oxide A | 0.5 |
| 74 | Charge control agent E | 1.0 | Silica A | 1.0 | Titanium oxide A | 1.5 |
| 75 | Charge control agent E | 1.0 | Silica A | 1.0 | Titanium oxide B | 0.5 |
| 76 | Charge control agent E | 1.0 | Silica A | 1.0 | Titanium oxide B | 1.5 |
| 77 | Charge control agent E | 1.0 | Silica A | 1.0 | Titanium oxide C | 0.5 |
| 78 | Charge control agent E | 1.0 | Silica A | 1.0 | Titanium oxide C | 2.0 |
| 79 | Charge control agent E | 1.0 | Silica A | 3.0 | Titanium oxide A | 0.5 |
| 80 | Charge control agent E | 1.0 | Silica A | 3.0 | Titanium oxide B | 0.5 |
| 81 | Charge control agent E | 1.0 | Silica A | 3.0 | Titanium oxide C | 0.5 |
| 82 | Charge control agent E | 1.0 | Silica A | 3.0 | Titanium oxide A | 1.5 |
| 83 | Charge control agent E | 1.0 | Silica B | 2.0 | Titanium oxide A | 0.5 |
| 84 | Charge control agent E | 1.0 | Silica B | 2.0 | Titanium oxide A | 1.0 |
| 85 | Charge control agent E | 1.0 | Silica B | 2.0 | Titanium oxide A | 2.0 |
| 86 | Charge control agent E | 1.0 | Silica B | 2.0 | Titanium oxide B | 0.5 |
| 87 | Charge control agent E | 1.0 | Silica B | 2.0 | Titanium oxide B | 1.0 |
| 88 | Charge control agent E | 1.0 | Silica B | 2.0 | Titanium oxide B | 2.0 |
| 89 | Charge control agent E | 1.0 | Silica B | 2.0 | Titanium oxide C | 0.5 |
| 90 | Charge control agent E | 1.0 | Silica B | 2.0 | Titanium oxide C | 1.0 |
| 91 | Charge control agent E | 1.0 | Silica B | 2.0 | Titanium oxide C | 2.0 |
| 92 | Charge control agent E | 2.0 | Silica B | 2.0 | Titanium oxide C | 2.0 |
| 93 | Charge control agent E | 1.0 | Silica C | 2.0 | Titanium oxide A | 0.5 |
| 94 | Charge control agent E | 3.0 | Silica C | 2.0 | Titanium oxide A | 1.5 |
| 95 | Charge control agent E | 3.0 | Silica C | 2.0 | Titanium oxide A | 2.0 |
| 96 | Charge control agent E | 3.0 | Silica C | 2.0 | Titanium oxide B | 0.5 |
| 97 | Charge control agent E | 3.0 | Silica C | 2.0 | Titanium oxide B | 1.0 |
| 98 | Charge control agent E | 3.0 | Silica C | 2.0 | Titanium oxide B | 2.0 |
| 99 | Charge control agent E | 3.0 | Silica C | 2.0 | Titanium oxide C | 0.5 |
| 100 | Charge control agent E | 2.0 | Silica C | 2.0 | Titanium oxide C | 1.0 |
| 101 | Charge control agent E | 2.0 | Silica C | 2.0 | Titanium oxide C | 2.0 |
| 102 | Charge control agent G | 2.0 | Silica A | 1.0 | Titanium oxide A | 0.5 |
| 103 | Charge control agent G | 2.0 | Silica A | 1.0 | Titanium oxide A | 1.0 |
| 104 | Charge control agent G | 2.0 | Silica A | 1.0 | Titanium oxide A | 2.0 |
| 105 | Charge control agent G | 2.0 | Silica A | 2.0 | Titanium oxide B | 0.5 |
| 106 | Charge control agent G | 2.0 | Silica A | 2.0 | Titanium oxide B | 1.0 |
| 107 | Charge control agent G | 2.0 | Silica A | 2.0 | Titanium oxide B | 2.0 |
| 108 | Charge control agent G | 2.0 | Silica A | 3.0 | Titanium oxide C | 0.5 |
| 109 | Charge control agent G | 2.0 | Silica A | 3.0 | Titanium oxide C | 1.0 |
| 110 | Charge control agent G | 2.0 | Silica A | 3.0 | Titanium oxide C | 2.0 |
| 111 | Charge control agent G | 2.0 | Silica B | 1.0 | Titanium oxide A | 0.5 |
| 112 | Charge control agent G | 2.0 | Silica B | 1.0 | Titanium oxide A | 1.0 |
| 113 | Charge control agent G | 2.0 | Silica B | 1.0 | Titanium oxide A | 2.0 |
| 114 | Charge control agent G | 2.0 | Silica B | 2.0 | Titanium oxide B | 0.5 |
| 115 | Charge control agent G | 2.0 | Silica B | 2.0 | Titanium oxide B | 1.0 |
| 116 | Charge control agent G | 2.0 | Silica B | 2.0 | Titanium oxide B | 2.0 |
| 117 | Charge control agent G | 2.0 | Silica C | 1.0 | Titanium oxide A | 0.5 |
| 118 | Charge control agent G | 2.0 | Silica C | 1.0 | Titanium oxide A | 1.0 |
| 119 | Charge control agent G | 2.0 | Silica C | 1.0 | Titanium oxide B | 1.5 |
| 120 | Charge control agent G | 2.0 | Silica C | 2.0 | Titanium oxide B | 0.5 |
| 121 | Charge control agent G | 2.0 | Silica C | 2.0 | Titanium oxide C | 2.0 |
| 122 | Charge control agent H | 2.0 | Silica A | 1.0 | Titanium oxide A | 0.5 |
| 123 | Charge control agent H | 2.0 | Silica A | 2.0 | Titanium oxide A | 1.0 |
| 124 | Charge control agent H | 2.0 | Silica A | 3.0 | Titanium oxide A | 2.0 |
| 25 | Charge control agent H | 2.0 | Silica A | 1.0 | Titanium oxide B | 0.5 |
| 126 | Charge control agent H | 2.0 | Silica A | 2.0 | Titanium oxide B | 1.0 |
| 127 | Charge control agent H | 2.0 | Silica A | 3.0 | Titanium oxide B | 2.0 |
| 128 | Charge control agent H | 2.0 | Silica A | 1.0 | Titanium oxide C | 0.5 |
| 129 | Charge control agent H | 2.0 | Silica A | 2.0 | Titanium oxide C | 1.0 |
| 130 | Charge control agent H | 2.0 | Silica A | 3.0 | Titanium oxide C | 2.0 |
| 131 | Charge control agent H | 2.0 | Silica B | 1.0 | Titanium oxide A | 0.5 |
| 132 | Charge control agent H | 2.0 | Silica B | 1.0 | Titanium oxide A | 1.0 |
| 133 | Charge control agent H | 2.0 | Silica B | 1.0 | Titanium oxide A | 2.0 |
| 134 | Charge control agent H | 2.0 | Silica B | 1.0 | Titanium oxide B | 0.5 |

TABLE 5-continued

| Comparative Example | Charge control agent(wt %) | | Silica(wt %) | | Titanium oxide (wt %) | |
|---|---|---|---|---|---|---|
| 135 | Charge control agent H | 2.0 | Silica B | 1.0 | Titanium oxide B | 1.0 |
| 136 | Charge control agent H | 2.0 | Silica B | 1.0 | Titanium oxide B | 2.0 |
| 137 | Charge control agent H | 2.0 | Silica B | 1.0 | Titanium oxide C | 0.5 |
| 138 | Charge control agent H | 2.0 | Silica B | 1.0 | Titanium oxide C | 1.0 |
| 139 | Charge control agent H | 2.0 | Silica B | 1.0 | Titanium oxide C | 2.5 |
| 140 | Charge control agent H | 2.0 | Silica B | 2.0 | Titanium oxide B | 1.0 |
| 141 | Charge control agent H | 2.0 | Silica B | 3.0 | Titanium oxide A | 3.0 |
| 142 | Charge control agent H | 2.0 | Silica C | 1.0 | Titanium oxide A | 0.5 |
| 143 | Charge control agent H | 2.0 | Silica C | 1.0 | Titanium oxide A | 1.0 |
| 144 | Charge control agent H | 2.0 | Silica C | 1.0 | Titanium oxide A | 2.0 |
| 145 | Charge control agent H | 2.0 | Silica C | 1.0 | Titanium oxide B | 0.5 |
| 146 | Charge control agent H | 2.0 | Silica C | 1.0 | Titanium oxide B | 2.0 |
| 147 | Charge control agent H | 2.0 | Silica C | 1.0 | Titanium oxide C | 2.0 |
| 148 | Charge control agent H | 2.0 | Silica C | 1.0 | Titanium oxide C | 3.0 |
| 149 | Charge control agent K | 2.0 | Silica A | 1.0 | Titanium oxide A | 0.5 |
| 150 | Charge control agent K | 2.0 | Silica A | 1.0 | Titanium oxide A | 1.0 |
| 151 | Charge control agent K | 2.0 | Silica A | 1.0 | Titanium oxide A | 2.0 |
| 152 | Charge control agent K | 2.0 | Silica A | 1.0 | Titanium oxide B | 0.5 |
| 153 | Charge control agent K | 2.0 | Silica A | 1.0 | Titanium oxide B | 1.0 |
| 154 | Charge control agent K | 2.0 | Silica A | 1.0 | Titanium oxide B | 3.0 |
| 155 | Charge control agent K | 2.0 | Silica A | 1.0 | Titanium oxide C | 0.5 |
| 156 | Charge control agent K | 2.0 | Silica A | 5.0 | Titanium oxide C | 1.0 |
| 157 | Charge control agent K | 2.0 | Silica A | 1.0 | Titanium oxide C | 3.0 |
| 158 | Charge control agent K | 1.0 | Silica A | 3.0 | Titanium oxide C | 3.0 |
| 159 | Charge control agent K | 1.0 | Silica B | 1.0 | Titanium oxide A | 0.5 |
| 160 | Charge control agent K | 1.0 | Silica B | 1.0 | Titanium oxide A | 1.0 |
| 161 | Charge control agent K | 1.0 | Silica B | 1.0 | Titanium oxide A | 2.5 |
| 162 | Charge control agent K | 1.0 | Silica B | 1.0 | Titanium oxide B | 1.0 |
| 163 | Charge control agent K | 1.0 | Silica B | 1.0 | Titanium oxide B | 2.0 |
| 164 | Charge control agent K | 1.0 | Silica B | 1.0 | Titanium oxide B | 3.0 |
| 165 | Charge control agent K | 1.0 | Silica B | 1.0 | Titanium oxide C | 1.0 |
| 166 | Charge control agent K | 1.0 | Silica C | 1.0 | Titanium oxide C | 2.0 |
| 167 | Charge control agent K | 1.0 | Silica C | 1.0 | Titanium oxide C | 1.0 |
| 168 | Charge control agent K | 1.0 | Silica C | 1.0 | Titanium oxide C | 3.0 |
| 169 | Charge control agent J | 2.0 | Silica A | 1.0 | Titanium oxide A | 1.0 |
| 170 | Charge control agent J | 2.0 | Silica A | 1.0 | Titanium oxide A | 2.0 |
| 171 | Charge control agent J | 2.0 | Silica A | 1.0 | Titanium oxide A | 1.0 |
| 172 | Charge control agent J | 2.0 | Silica A | 1.0 | Titanium oxide B | 1.0 |
| 173 | Charge control agent P | 1.0 | Silica A | 1.0 | Titanium oxide A | 1.0 |
| 174 | Charge control agent P | 1.0 | Silica A | 1.0 | Titanium oxide A | 2.0 |
| 175 | Charge control agent P | 1.0 | Silica A | 1.0 | Titanium oxide A | 1.0 |
| 176 | Charge control agent P | 1.0 | Silica A | 1.0 | Titanium oxide B | 1.0 |
| 177 | Charge control agent P | 1.0 | Silica A | 1.0 | Titanium oxide B | 2.0 |
| 178 | Charge control agent P | 1.0 | Silica A | 1.0 | Titanium oxide B | 3.0 |
| 179 | Charge control agent P | 1.0 | Silica A | 1.0 w | Titanium oxide C | 1.0 |
| 180 | Charge control agent P | 1.0 | Silica A | 1.0 | Titanium oxide C | 2.0 |
| 181 | Charge control agent P | 1.0 | Silica A | 1.0 | Titanium oxide C | 3.0 |
| 182 | Charge control agent P | 1.0 | Silica A | 2.0 | Titanium oxide A | 1.0 |
| 183 | Charge control agent P | 1.0 | Silica B | 5.0 | Titanium oxide B | 1.0 |
| 184 | Charge control agent P | 2.0 | Silica B | 1.0 | Titanium oxide A | 1.0 |
| 185 | Charge control agent P | 2.0 | Silica C | 1.0 | Titanium oxide A | 2.0 |
| 186 | Charge control agent P | 2.0 | Silica B | 1.0 | Titanium oxide A | 3.0 |
| 187 | Charge control agent P | 2.0 | Silica B | 1.0 | Titanium oxide B | 1.0 |
| 188 | Charge control agent P | 2.0 | Silica B | 1.0 | Titanium oxide B | 2.0 |
| 189 | Charge control agent P | 2.0 | Silica B | 1.0 | Titanium oxide B | 3.0 |
| 190 | Charge control agent P | 2.0 | Silica C | 1.0 | Titanium oxide C | 1.0 |
| 191 | Charge control agent P | 3.0 | Silica B | 1.0 | Titanium oxide C | 2.0 |
| 192 | Charge control agent P | 4.0 | Silica B | 1.0 | Titanium oxide C | 3.0 |
| 193 | Charge control agent P | 8.0 | Silica C | 2.0 | Titanium oxide A | 1.0 |
| 194 | Charge control agent Q | 1.0 | Silica A | 1.0 | Titanium oxide A | 1.0 |
| 195 | Charge control agent Q | 1.0 | Silica A | 1.0 | Titanium oxide A | 2.0 |
| 196 | Charge control agent Q | 1.0 | Silica A | 1.0 | Titanium oxide A | 1.0 |
| 197 | Charge control agent Q | 1.0 | Silica A | 1.0 | Titanium oxide B | 1.0 |
| 198 | Charge control agent Q | 1.0 | Silica A | 1.0 | Titanium oxide B | 2.0 |
| 199 | Charge control agent Q | 1.0 | Silica A | 1.0 | Titanium oxide B | 3.0 |
| 200 | Charge control agent Q | 1.0 | Silica C | 1.0 | Titanium oxide C | 1.0 |
| 201 | Charge control agent Q | 1.0 | Silica C | 1.0 | Titanium oxide C | 2.0 |
| 202 | Charge control agent Q | 1.0 | Silica A | 1.0 | Titanium oxide C | 3.0 |
| 203 | Charge control agent Q | 1.0 | Silica A | 2.0 | Titanium oxide A | 1.0 |
| 204 | Charge control agent Q | 2.0 | Silica A | 5.0 | Titanium oxide B | 1.0 |
| 205 | Charge control agent Q | 2.0 | Silica B | 1.0 | Titanium oxide A | 1.0 |
| 206 | Charge control agent Q | 2.0 | Silica B | 1.0 | Titanium oxide A | 2.0 |
| 207 | Charge control agent Q | 2.0 | Silica B | 1.0 | Titanium oxide A | 3.0 |
| 208 | Charge control agent Q | 2.0 | Silica B | 5.0 | Titanium oxide B | 1.0 |
| 209 | Charge control agent Q | 2.0 | Silica B | 5.0 | Titanium oxide B | 2.0 |
| 210 | Charge control agent Q | 2.0 | Silica B | 1.0 | Titanium oxide B | 3.0 |

TABLE 5-continued

| Comparative Example | Charge control agent(wt %) | | Silica(wt %) | | Titanium oxide (wt %) | |
|---|---|---|---|---|---|---|
| 211 | Charge control agent Q | 2.0 | Silica B | 1.0 | Titanium oxide C | 1.0 |
| 212 | Charge control agent Q | 3.0 | Silica B | 1.0 | Titanium oxide C | 2.0 |
| 213 | Charge control agent Q | 5.0 | Silica B | 1.0 | Titanium oxide C | 3.0 |
| 214 | Charge control agent Q | 6.0 | Silica B | 2.0 | Titanium oxide A | 1.0 |
| 215 | Charge control agent Q | 3.0 | Silica C | 1.0 | Titanium oxide A | 1.0 |
| 216 | Charge control agent R | 1.0 | Silica A | 1.0 | Titanium oxide A | 0.5 |
| 217 | Charge control agent R | 1.0 | Silica A | 1.0 | Titanium oxide A | 1.0 |
| 218 | Charge control agent R | 1.0 | Silica A | 1.0 | Titanium oxide A | 2.0 |
| 219 | Charge control agent R | 1.0 | Silica A | 1.0 | Titanium oxide B | 0.5 |
| 220 | Charge control agent R | 1.0 | Silica A | 1.0 | Titanium oxide B | 1.0 |
| 221 | Charge control agent R | 1.0 | Silica A | 1.0 | Titanium oxide B | 2.0 |
| 222 | Charge control agent R | 1.0 | Silica A | 1.0 | Titanium oxide C | 0.5 |
| 223 | Charge control agent R | 1.0 | Silica A | 5.0 | Titanium oxide C | 1.0 |
| 224 | Charge control agent R | 1.0 | Silica A | 6.0 | Titanium oxide C | 3.0 |
| 225 | Charge control agent R | 1.0 | Silica B | 6.0 | Titanium oxide A | 0.5 |
| 226 | Charge control agent R | 1.0 | Silica B | 1.0 | Titanium oxide A | 1.0 |
| 227 | Charge control agent R | 2.0 | Silica B | 1.0 | Titanium oxide A | 2.0 |
| 228 | Charge control agent R | 2.0 | Silica B | 1.0 | Titanium oxide B | 0.5 |
| 229 | Charge control agent R | 2.0 | Silica B | 1.0 | Titanium oxide B | 1.0 |
| 230 | Charge control agent R | 2.0 | Silica B | 1.0 | Titanium oxide B | 5.0 |
| 231 | Charge control agent R | 6.0 | Silica B | 1.0 | Titanium oxide C | 0.5 |
| 232 | Charge control agent R | 5.0 | Silica B | 1.0 | Titanium oxide C | 1.0 |
| 233 | Charge control agent S | 1.0 | Silica B | 1.0 | Titanium oxide C | 2.0 |
| 234 | Charge control agent S | 1.0 | Silica C | 2.0 | Titanium oxide A | 0.5 |
| 235 | Charge control agent S | 1.0 | Silica C | 2.0 | Titanium oxide A | 1.0 |
| 236 | Charge control agent S | 1.0 | Silica C | 2.0 | Titanium oxide A | 2.0 |
| 237 | Charge control agent S | 1.0 | Silica C | 2.0 | Titanium oxide B | 0.5 |
| 238 | Charge control agent S | 1.0 | Silica C | 2.0 | Titanium oxide B | 1.0 |
| 239 | Charge control agent S | 1.0 | Silica C | 2.0 | Titanium oxide B | 2.0 |
| 240 | Charge control agent S | 1.0 | Silica C | 2.0 | Titanium oxide C | 0.5 |
| 241 | Charge control agent S | 1.0 | Silica C | 2.0 | Titanium oxide C | 1.0 |
| 242 | Charge control agent S | 1.0 | Silica C | 2.0 | Titanium oxide C | 2.0 |
| 243 | Charge control agent S | 1.0 | Silica A | 1.0 | Titanium oxide A | 0.5 |
| 244 | Charge control agent S | 2.0 | Silica A | 1.0 | Titanium oxide A | 1.0 |
| 245 | Charge control agent S | 2.0 | Silica A | 1.0 | Titanium oxide A | 2.0 |
| 246 | Charge control agent S | 2.0 | Silica A | 1.0 | Titanium oxide B | 0.5 |
| 247 | Charge control agent S | 2.0 | Silica A | 1.0 | Titanium oxide B | 1.0 |
| 248 | Charge control agent S | 2.0 | Silica A | 1.0 | Titanium oxide B | 2.0 |
| 249 | Charge control agent S | 2.0 | Silica A | 1.0 | Titanium oxide C | 0.5 |
| 250 | Charge control agent S | 2.0 | Silica A | 1.0 | Titanium oxide C | 1.0 |
| 251 | Charge control agent S | 2.0 | Silica A | 1.0 | Titanium oxide C | 2.0 |
| 252 | Charge control agent S | 2.0 | Silica B | 1.0 | Titanium oxide B | 2.0 |
| 253 | Charge control agent S | 3.0 | Silica B | 1.0 | Titanium oxide C | 0.5 w |
| 254 | Charge control agent S | 3.0 | Silica B | 1.0 | Titanium oxide C | 1.0 |
| 255 | Charge control agent S | 3.0 | Silica B | 1.0 | Titanium oxide C | 2.0 |
| 256 | Charge control agent S | 2.0 | Silica A | 1.0 | Titanium oxide B | 0.5 |
| 257 | Charge control agent S | 2.0 | Silica A | 1.0 | Titanium oxide B | 1.0 |
| 258 | Charge control agent S | 2.0 | Silica A | 1.0 | Titanium oxide B | 2.0 |
| 259 | Charge control agent S | 2.0 | Silica A | 1.0 | Titanium oxide C | 0.5 |
| 260 | Charge control agent S | 2.0 | Silica A | 1.0 | Titanium oxide C | 1.0 |
| 261 | Charge control agent S | 2.0 | Silica A | 1.0 | Titanium oxide C | 2.0 |
| 262 | Charge control agent S | 2.0 | Silica B | 1.0 | Titanium oxide B | 2.0 |
| 263 | Charge control agent S | 5.0 | Silica B | 1.0 | Titanium oxide C | 0.5 |
| 264 | Charge control agent S | 6.0 | Silica B | 1.0 | Titanium oxide C | 1.0 |
| 265 | Charge control agent S | 10.0 | Silica B | 1.0 | Titanium oxide C | 2.0 |
| 266 | Charge control agent R | 1.0 | Silica A | 1.0 | Titanium oxide C | 0.5 |
| 267 | Charge control agent R | 5.0 | Silica A | 5.0 | Titanium oxide C | 3.0 |
| 268 | Charge control agent R | 1.0 | Silica A | 5.0 | Titanium oxide C | 3.0 |
| 269 | Charge control agent R | 1.0 | Silica B | 0.5 | Titanium oxide A | 0.5 |
| 270 | Charge control agent R | 5.0 | Silica B | 1.0 | Titanium oxide A | 1.0 |

TESTING EXAMPLE 1

5,000 sheets of paper was printed with each of the non-magnetic monocomponent color toner prepared in Examples 1-182 and Comparative Examples 1-270 using a contact type of non-magnetic monocomponent development printer (HP 4600, Hewlett-Packard) at normal temperature and humidity (20° C., 55% RH). Image density, printing efficiency, and long-term stability were tested. The results are given in Table 6 below.

1) Image Density (I.D.)

Solid area was measured using a Macbeth reflectance densitometer RD918.

○: Image density was 1.4 or above.

Δ: Image density was 1.2-1.4.

×: Image density was 1.0-1.2.

2) Printing efficiency

Of the 5,000 sheets of paper, printing efficiency was calculated by counting the number of wasted sheets per each 500 sheets.

: Printing efficiency was 80% or over.

○: Printing efficiency was 70-80%.

Δ: Printing efficiency was 60-70%.

×: Printing efficiency was 50-60%.

3) Long-term stability

It was confirmed if I.D. and printing efficiency were maintained after printing 5,000 sheets.

A: I.D. was 1.4 or over and printing efficiency was 80% or over.

B: I.D. was 1.3-1.4 and printing efficiency was 70-80%.

C: I.D. was 1.2-1.3 and printing efficiency was 60-70%.

D: I.D. was 1.0-1.2 and printing efficiency was 50-60%.

TABLE 6

| Example | Image density | Printing efficiency | Long-term stability |
|---|---|---|---|
| 1 | ○ | ◎ | A |
| 2 | ○ | ◎ | A |
| 3 | ○ | ◎ | A |
| 4 | ○ | ◎ | A |
| 5 | ○ | ◎ | A |
| 6 | ○ | ◎ | A |
| 7 | ○ | ○ | A |
| 8 | ○ | ◎ | A |
| 9 | ○ | ◎ | A |
| 10 | ○ | ◎ | A |
| 11 | ○ | ◎ | A |
| 12 | ○ | ◎ | A |
| 13 | ○ | ◎ | B |
| 14 | ○ | ◎ | A |
| 15 | ○ | ◎ | A |
| 16 | ○ | ◎ | A |
| 17 | ○ | ◎ | A |
| 18 | ○ | ◎ | A |
| 19 | ○ | ◎ | A |
| 20 | ○ | ◎ | A |
| 21 | ○ | ◎ | A |
| 22 | ○ | ◎ | A |
| 23 | ○ | ◎ | A |
| 24 | ○ | ◎ | A |
| 25 | ○ | ◎ | A |
| 26 | ○ | ◎ | A |
| 27 | ○ | ◎ | A |
| 28 | ○ | ○ | A |
| 29 | ○ | ◎ | A |
| 30 | ○ | ◎ | A |
| 31 | ○ | ◎ | A |
| 32 | ○ | ◎ | A |
| 33 | ○ | ◎ | A |
| 34 | ○ | ◎ | A |
| 35 | ○ | ◎ | A |
| 36 | ○ | ◎ | A |
| 37 | ○ | ◎ | A |
| 38 | ○ | ◎ | A |
| 39 | ○ | ◎ | A |
| 40 | ○ | ◎ | A |
| 41 | ○ | ◎ | A |
| 42 | ○ | ◎ | A |
| 43 | ○ | ○ | B |
| 44 | ○ | ◎ | A |
| 45 | ○ | ◎ | A |
| 46 | ○ | ○ | B |
| 47 | ○ | ◎ | A |
| 48 | ○ | ◎ | A |
| 49 | ○ | ○ | B |
| 50 | ○ | ◎ | A |
| 51 | ○ | ◎ | A |
| 52 | ○ | ◎ | B |
| 53 | ○ | ◎ | A |
| 54 | ○ | ◎ | A |
| 55 | ○ | ○ | A |
| 56 | ○ | ○ | A |
| 57 | ○ | ◎ | A |
| 58 | ○ | ◎ | A |
| 59 | ○ | ◎ | A |
| 60 | ○ | ◎ | A |
| 61 | ○ | ◎ | A |
| 62 | ○ | ○ | A |
| 63 | ○ | ◎ | A |

TABLE 6-continued

| Example | Image density | Printing efficiency | Long-term stability |
|---|---|---|---|
| 64 | ○ | ○ | B |
| 65 | ○ | ◎ | A |
| 66 | ○ | ◎ | A |
| 67 | ○ | ◎ | A |
| 68 | ○ | ○ | B |
| 69 | ○ | ◎ | A |
| 70 | ○ | ◎ | A |
| 71 | ○ | ◎ | A |
| 72 | ○ | ◎ | A |
| 73 | ○ | ◎ | A |
| 74 | ○ | ◎ | A |
| 75 | ○ | ◎ | A |
| 76 | ○ | ◎ | A |
| 77 | ○ | ◎ | A |
| 78 | ○ | ◎ | A |
| 79 | Δ | ◎ | B |
| 80 | ○ | ◎ | A |
| 81 | ○ | ◎ | A |
| 82 | ○ | ◎ | A |
| 83 | ○ | ◎ | A |
| 84 | ○ | ◎ | A |
| 85 | ○ | ◎ | A |
| 86 | ○ | ◎ | A |
| 87 | ○ | ◎ | A |
| 88 | ○ | ○ | A |
| 89 | ○ | ◎ | A |
| 90 | ○ | ◎ | A |
| 91 | ○ | ◎ | A |
| 92 | ○ | ◎ | A |
| 93 | ○ | ◎ | A |
| 94 | ○ | ◎ | A |
| 95 | Δ | ◎ | A |
| 96 | ○ | ◎ | A |
| 97 | ○ | ◎ | A |
| 98 | ○ | ◎ | A |
| 99 | ○ | ◎ | A |
| 100 | ○ | ◎ | A |
| 101 | ○ | ○ | B |
| 101 | ○ | ◎ | A |
| 102 | ○ | ◎ | A |
| 103 | ○ | ◎ | A |
| 104 | ○ | ◎ | A |
| 105 | ○ | ◎ | A |
| 106 | ○ | ◎ | A |
| 107 | ○ | ◎ | A |
| 108 | ○ | ◎ | A |
| 109 | ○ | ◎ | A |
| 110 | ○ | ◎ | A |
| 111 | ○ | ◎ | A |
| 112 | ○ | ◎ | A |
| 113 | ○ | ◎ | A |
| 114 | ○ | ◎ | A |
| 115 | ○ | ◎ | A |
| 116 | ○ | ◎ | A |
| 117 | ○ | ◎ | A |
| 118 | ○ | ◎ | A |
| 119 | ○ | ◎ | A |
| 120 | ○ | ◎ | A |
| 121 | ○ | ◎ | A |
| 122 | ○ | ◎ | A |
| 123 | ○ | ◎ | A |
| 124 | ○ | ◎ | A |
| 125 | ○ | ◎ | B |
| 126 | ○ | ◎ | A |
| 127 | ○ | ◎ | A |
| 128 | ○ | ○ | A |
| 129 | ○ | ◎ | A |
| 130 | ○ | ◎ | A |
| 131 | ○ | ◎ | A |
| 132 | ○ | ◎ | A |
| 133 | ○ | ◎ | A |
| 134 | ○ | ◎ | A |
| 135 | ○ | ◎ | A |
| 136 | ○ | ◎ | A |
| 137 | ○ | ◎ | A |
| 138 | ○ | ◎ | A |

TABLE 6-continued

| Example | Image density | Printing efficiency | Long-term stability |
|---|---|---|---|
| 139 | ○ | ◎ | A |
| 140 | ○ | ◎ | A |
| 141 | ○ | ◎ | A |
| 142 | ○ | ◎ | A |
| 143 | ○ | ○ | B |
| 144 | ○ | ◎ | A |
| 145 | ○ | ◎ | A |
| 146 | ○ | ○ | B |
| 47 | ○ | ◎ | A |
| 148 | ○ | ◎ | A |
| 149 | ○ | ○ | B |
| 150 | ○ | ◎ | A |
| 151 | ○ | ◎ | A |
| 152 | ○ | ○ | B |
| 153 | ○ | ◎ | A |
| 154 | ○ | ○ | A |
| 155 | ○ | ◎ | A |
| 156 | ○ | ○ | A |
| 157 | ○ | ◎ | A |
| 158 | ○ | ◎ | A |
| 159 | ○ | ◎ | A |
| 160 | ○ | ◎ | A |
| 161 | ○ | ◎ | A |
| 162 | ○ | ◎ | A |
| 163 | ○ | ◎ | A |
| 164 | ○ | ◎ | A |
| 165 | ○ | ◎ | A |
| 166 | ○ | ◎ | A |
| 167 | ○ | ◎ | A |
| 168 | ○ | ◎ | A |
| 169 | ○ | ◎ | A |
| 170 | ○ | ◎ | A |
| 171 | ○ | ◎ | A |
| 172 | ○ | ◎ | A |
| 173 | ○ | ◎ | B |
| 174 | ○ | ◎ | A |
| 175 | ○ | ◎ | A |
| 176 | ○ | ◎ | A |
| 177 | ○ | ◎ | A |
| 178 | ○ | ○ | A |
| 179 | ○ | ○ | A |
| 180 | ○ | ○ | A |
| 181 | ○ | ○ | A |
| 182 | ○ | ◎ | A |

TABLE 7

| Comparative Example | Image density | Printing efficiency | Long-term stability |
|---|---|---|---|
| 1 | x | x | D |
| 2 | x | Δ | C |
| 3 | Δ | x | D |
| 4 | x | x | D |
| 5 | x | x | D |
| 6 | Δ | x | D |
| 7 | x | x | D |
| 8 | x | x | C |
| 9 | Δ | x | D |
| 10 | x | x | D |
| 11 | x | x | C |
| 12 | Δ | x | D |
| 13 | x | x | D |
| 14 | x | x | C |
| 15 | x | x | D |
| 16 | x | x | D |
| 17 | x | x | C |
| 18 | Δ | x | D |
| 19 | x | x | D |
| 20 | x | x | D |
| 21 | x | x | D |
| 22 | x | Δ | D |
| 23 | x | x | D |

TABLE 7-continued

| Comparative Example | Image density | Printing efficiency | Long-term stability |
|---|---|---|---|
| 24 | x | x | D |
| 25 | x | x | D |
| 26 | x | x | C |
| 27 | x | x | D |
| 28 | x | Δ | D |
| 29 | x | x | D |
| 30 | x | x | D |
| 31 | x | Δ | D |
| 32 | x | x | D |
| 33 | x | x | D |
| 34 | x | Δ | D |
| 35 | x | x | D |
| 36 | x | x | D |
| 37 | x | Δ | D |
| 38 | x | x | D |
| 39 | x | x | D |

As seen in Table 6 and Table 7, when a charge control agent having a specific shaped particle size distribution was used, as in the present invention, image density, printing efficiency, and long-term stability were superior. This is because the charge control agent particle having a larger particle size tends to be present on the surface, while the charge control agent particle having a smaller particle size does not because of a stronger binding ability with the binder resin.

As apparent from the above description, the non-magnetic monocomponent color toner of the present invention, which comprises a charge control agent having a specific shaped particle size distribution, enables excellent functioning as a charge control agent because the charge control agent particle having a smaller particle size has good binding ability with the binder resin and the charge control agent having a larger particle size tends to be present on the surface. The toner comprising such a charge control agent offers higher resolution because of good chargeability and ensures long-term stability because of uniform charge distribution.

While the present invention has been described in detail with reference to exemplary embodiments, those skilled in the art will appreciate that various modifications and substitutions can be made thereto without departing from the spirit and scope of the present invention as set forth in the appended claims.

What is claimed is:

1. A non-magnetic monocomponent color toner comprising a toner mother particle comprising 10-35 wt % of a charge control agent having an average particle size of 50-500 nm and 65-90 wt % of a charge control agent having an average particle size of 1-4 μm; silica; and titanium dioxide.

2. The non-magnetic monocomponent color toner of claim 1, wherein the toner mother particle further comprises a binder resin, a colorant, and a wax.

3. The non-magnetic monocomponent color toner of claim 1, wherein the toner mother particle has an average particle size of at most 10 μm.

4. The non-magnetic monocomponent color toner of claim 1, wherein the silica has an average particle size of 5-50 nm.

5. The non-magnetic monocomponent color toner of claim 1, wherein the silica is comprised at 1.0-3.0 wt %.

6. The non-magnetic monocomponent color toner of claim 1, wherein the titanium dioxide has an average particle size of 0.05-2 μm.

7. A method of preparing a non-magnetic monocomponent color toner comprising the steps of preparing a toner mother particle comprising 10-35 wt % of a charge control agent having a particle size of 50-500 nm and 65-90 wt % of a charge control agent having a particle size of 1-4 μm (step 1); and coating the toner mother particle with silica and titanium dioxide (step 2).

8. The method of claim 7, wherein the coating is stirred at the rate of at least 10 m/s after mixing the toner mother particle with the silica and the titanium dioxide.

* * * * *